US009180513B2

(12) United States Patent
Huber et al.

(10) Patent No.: US 9,180,513 B2
(45) Date of Patent: Nov. 10, 2015

(54) PROCESS FOR PRODUCING A CAST WHEEL AND CASTING MOULD

(75) Inventors: Helmuth Huber, Maria Schmolln (AT); Manfred Johannes Ebetshuber, Gurten (AT); Josef Gartner, Mining (AT)

(73) Assignee: BORBET AUSTRIA GMBH, Ranshofen (AT)

( * ) Notice: Subject to any disclaimer, the term of this patent is extended or adjusted under 35 U.S.C. 154(b) by 0 days.

(21) Appl. No.: 13/990,667

(22) PCT Filed: Dec. 2, 2011

(86) PCT No.: PCT/AT2011/000485

§ 371 (c)(1), (2), (4) Date: May 30, 2013

(87) PCT Pub. No.: WO2012/071599

PCT Pub. Date: Jun. 7, 2012

(65) Prior Publication Data

US 2013/0240168 A1 Sep. 19, 2013

(30) Foreign Application Priority Data

Dec. 2, 2010 (AT) ..... A 2006/2010

(51) Int. Cl.
*B22D 19/00* (2006.01)
*B22C 9/06* (2006.01)
(Continued)

(52) U.S. Cl.
CPC ..... *B22D 19/00* (2013.01); *B22C 9/064* (2013.01); *B22C 9/108* (2013.01); *B22C 9/28* (2013.01); *B22D 15/005* (2013.01)

(58) Field of Classification Search
CPC ..... B22C 9/064; B22C 9/108; B22C 9/28
USPC ..... 164/112, 30, 137, 334, 340, 397–399; 301/65
See application file for complete search history.

(56) References Cited

U.S. PATENT DOCUMENTS 3,253,862 A * 5/1966 Watanabe et al. ..... 301/65
3,545,524 A * 12/1970 Dabney et al. ..... 164/33
(Continued)

FOREIGN PATENT DOCUMENTS

AT 409 728 10/2002
DE 42 01 278 7/1993
(Continued)

OTHER PUBLICATIONS

China Office Action conducted in counterpart China Appln. No. 201180058387.0 (Sep. 1, 2014) (w/ English translation).

*Primary Examiner* — Kevin E Yoon
(74) *Attorney, Agent, or Firm* — Geenblum & Bernstein, P.L.C.

(57) ABSTRACT

Process and casting mold for producing a cast wheel. A core, which remains in the cast wheel and has a circumferential rim, is inserted into a casting mold having at least one lower mold part and an upper mold part moved relative to one another to close casting mold. Core is positioned by at least one positioning element in a predetermined position in casting mold, so that an end region of positioning element is fixed with a force fit or frictional fit in circumferential rim of the core. A free end region of positioning element, which protrudes from circumferential rim of the core, is placed on a contact surface, which is preferably arranged substantially horizontally during operation, of lower mold part during positioning of core in casting mold. Core is positioned in the predetermined position under the action of the force of gravity.

10 Claims, 3 Drawing Sheets

Figure 1:
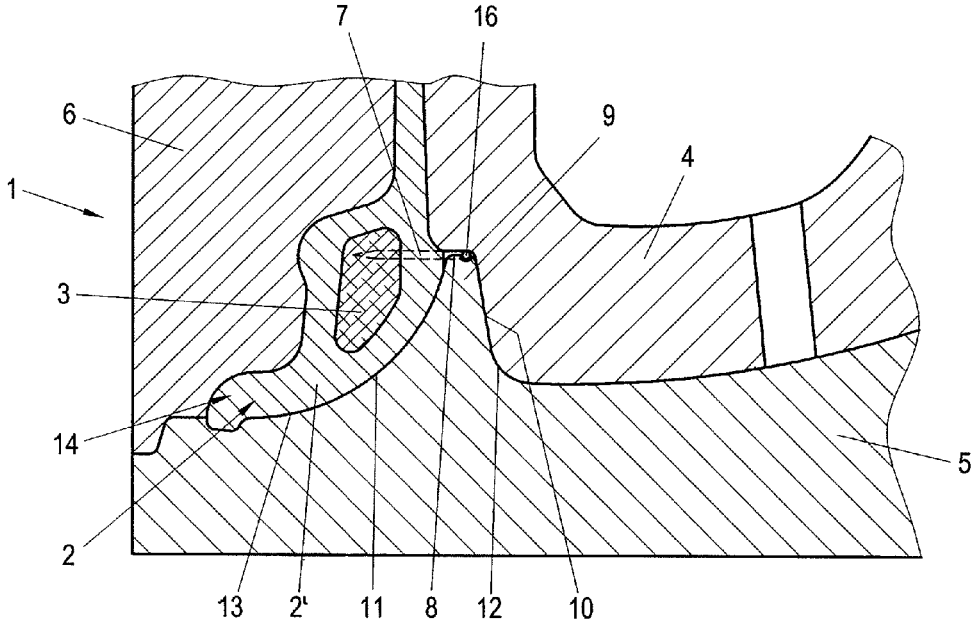

(51) Int. Cl.

| | |
|---|---|
| ***B22C 9/10*** | (2006.01) |
| ***B22D 15/00*** | (2006.01) |
| ***B22C 9/28*** | (2006.01) |

(56) References Cited

U.S. PATENT DOCUMENTS

| | | | | |
|---|---|---|---|---|
| 6,158,820 | A * | 12/2000 | Archibald et al. | 301/65 |
| 6,186,218 | B1 * | 2/2001 | Prieto | 164/339 |
| 6,877,820 | B2 * | 4/2005 | Langgartner | 301/65 |
| 2007/0131377 | A1 | 6/2007 | Suzuki et al. | |
| 2008/0087401 | A1 | 4/2008 | Ebetshuber | |
| 2011/0132566 | A1 | 6/2011 | Ebetshuber | |
| 2012/0019047 | A1 * | 1/2012 | Niedermayer | 301/5.1 |

FOREIGN PATENT DOCUMENTS

| | | |
|---|---|---|
| DE | 20 2006 01407 | 11/2006 |
| DE | 10 2007 04612 | 7/2008 |
| EP | 1 792 674 | 6/2007 |
| JP | 2007 038275 | 2/2007 |
| WO | 99/39923 | 8/1999 |
| WO | 2006/042350 | 4/2006 |

* cited by examiner

PROCESS FOR PRODUCING A CAST WHEEL AND CASTING MOULD

The invention relates to a process for producing a cast wheel, wherein a core, which remains in the cast wheel and has a circumferential rim, is inserted into a casting mould having at least a lower mould part and an upper mould part, which are moved relative to one another to close the casting mould, wherein the core is positioned by means of at least one positioning element in a predetermined position in the casting mould, wherein an end region of the positioning element is fixed with a force fit or frictional fit in the circumferential rim of the core.

The invention further relates to a casting mould for producing a cast workpiece, in particular a cast wheel, having at least a lower mould part and an upper mould part, which are movable relative to one another to close the casting mould.

A process for producing a rim of a cast wheel is known from AT 409 728 B, in which a pre-formed core part made of metal foam is inserted into a casting mould comprising an upper coquille part, a lower coquille part and lateral core sliders. The core part is fixed in its position by means of positioning elements and then surrounded by a light metal. For discharging gases that escape during the surrounding of the core part, the casting mould and/or the positioning element include(s) a vent. The positioning elements remaining in the cast wheel are fixed to the core. For centring the core part within the casting mould, the positioning elements connect to the movable upper coquille part in a self-locking manner. For this purpose the positioning element has a conical jacket surface which triggers the self-locking effect by being placed on a protrusion in the vent of the upper coquille part, which protrusion forms a narrowing of the cross-section. This technique has proven useful, in particular, for holding the core part in the predetermined position by means of positioning elements if it is possible to attach the positioning elements to ribs of the core part which protrude radially to the inside from a circular annular outer part. In this design, the positioning elements protruding from the ribs in the axial direction may be locked in the corresponding vent of the upper coquille part. In many cases, however, it is not possible to provide such a connection. In particular, this is the case if the core part does not comprise ribs protruding radially to the inside for attaching the positioning elements. This is why it would be particularly desirable to enable an accurate positioning of the core even if the core does not comprise ribs protruding into the spokes of the wheel.

Furthermore, a casting mould for casting a hollow cam shaft is known from DE 42 01 278 A1. Here, a casting core having a free end is arranged in the casting mould. A support is provided for supporting the free end of the casting core. The support comprises anchoring sections on both sides of the casting core, which are anchored between the lower part and the upper part of the casting mould. As a consequence, the support extends between opposite sides of the casting mould. This design, however, is only provided and/or suitable for casting other types of moulded parts.

WO 2006/042350 A1 and EP 1 792 674 A1 disclose positioning devices of other types.

In contrast to this, it is the object of the present invention to provide a process and a casting mould for producing a cast wheel with an annular-shaped core of the initially mentioned type, ensuring an accurate positioning of the core in the casting mould while allowing the core to be designed in as many forms as possible.

In the process of the initially mentioned type, this is achieved by placing a free end region of the positioning element, which end region protrudes from the circumferential rim of the core, on a contact surface, which is preferably arranged substantially horizontally during operation, of the lower mould part of the casting mould during positioning of the core in the casting mould, so the core is positioned in the predetermined position under the action of the force of gravity.

According to this, the positioning element is placed on the corresponding contact surface of the lower mould part of the casting mould for positioning the core in the casting mould. In this position, the core is positioned under the action of the force of gravity without touching the mould parts of the casting mould. The core is thus mainly held by the core's own weight, so a stable support on the contact surface is achieved. Accordingly, it is not required to provide a locking connection between the positioning element and the associated mould part of the casting mould for centring the core. Advantageously, the positioning element is placed on a contact surface that is arranged substantially horizontally with respect to the operating position of the positioning element; depending on the design, however, it might also be conceivable to provide a contact surface that is inclined with respect to the horizontal plane, but not without making sure that the core is held in a stable position with respect to the mould parts of the casting mould by the action of the force of gravity.

For the accurate positioning of the core, it is favourable for the positioning element to be locked between the contact surface of the lower mould part and a corresponding contact surface of the upper mould part when closing the casting mould. During the production of the cast workpiece, the core is first placed on the contact surface of the lower mould part before moving the mould parts towards each other for closing the casting mould, with the positioning element being locked between the corresponding contact surfaces of the casting mould. Thereby, the core is secured against displacement during the casting procedure, so the core is arranged in the desired position in the completed cast workpiece with a high accuracy.

In order to position the core in the predetermined position within the casting mould, it is favourable for a pin-shaped, bracket-shaped or plate-shaped end region of the positioning element protruding from the core to be placed on the contact surface of the lower mould part. Preferably the other end region of the positioning element is fixed within the core by a frictional fit and/or a force fit. The shape of the end region protruding from the core determines the area of contact with the contact surface of the lower mould part. In the case of a pin-shaped end region of the positioning element, the area of contact provided is comparably small; in contrast to this, a larger area of contact between the positioning element and the contact surface can be obtained by means of the plate-shaped end region.

In a particularly preferred embodiment of the invention, it is provided that an end region of the positioning element protruding from a circumferential rim of the core substantially radially to the inside is placed on the contact surface of the lower mould part. When surrounding the core by a light metal, a cast workpiece is formed, enclosing the particularly circular circumferential rim. This process is particularly useful for producing a cast wheel in which the core is arranged substantially entirely in an edge of a circumferential wheel rim. For the formation of the cast wheel, it is especially advantageous if the rim has pockets which protrude particularly radially to the inside and which can extend into the spokes of the cast wheel, if desired.

For the accurate positioning of the core in the casting mould, it is advantageous for a plurality of positioning elements, attached to the circumferential rim of the core spaced apart from each other in the direction of the circumference, to be placed on appropriate contact surfaces of the lower mould part. In order to provide a uniform support for the core on the lower mould part, it is particularly favourable for the positioning elements to be arranged at substantially regular angular distances on the circumferential rim. Of course, however, the positioning elements may be positioned anywhere on the core, i.e. without an imperative predetermined regular distribution. Upon inserting the core into the casting mould, the positioning elements are placed on the appropriate contact surfaces of the lower mould part.

In order to avoid negative effects due to the positioning elements remaining in the cast workpiece, it is advantageous to remove an end of the positioning element protruding from the completed cast workpiece, in particular by cutting or twisting it off.

To prevent corrosion, which was possible at the exit positions of the positioning elements in previous processes, it is advantageous if the cast workpiece is lacquered or powder-coated, at least in the region of the cut-off end of the positioning element. In a preferred embodiment, a lacquer finish is applied onto the entire cast workpiece to avoid the risk of corrosion as effective as possible.

In a casting mould of the initially mentioned type, the basic task of the invention is accomplished by the lower mould part comprising a circular circumferential elevation with a contact surface on which a free end region of a positioning element which is connected to a circumferential rim of a core can be placed, so the core can be positioned within the casting mould without touching the mould parts. The casting mould according to the invention thus provides the same advantages as the process discussed above, so reference is made to the previous statements in order to avoid repetition.

For producing a cast workpiece with a circular circumferential portion, and in particular for producing a cast wheel, it is favourable if the circular circumferential elevation is formed as a portion of boundary surfaces enclosing a cavity. The shape of the completed cast workpiece is determined by the cavity enclosed by the boundary surfaces.

For a stable positioning of the core in the predetermined position, it is advantageous if the contact surface is arranged substantially horizontally during operation. The arrangement of the contact surface guarantees that, under the action of the force of gravity, the core is held without touching at least the lower mould part. In principle, this can also be achieved by a contact surface inclined at a low angle, depending on the design.

In order to secure the core in the predetermined position against lateral displacement, it is advantageous if the upper mould part and/or the lower mould-part comprise(s) a groove. Preferably, the shape of the groove corresponds to the outer contour of the positioning element inserted into the groove, so the positioning element cannot move to the side when the core is being surrounded by a light metal.

In order to secure the core against displacement in any spatial direction when surrounding it by a light metal, it is advantageous if, in a closed position of the casting mould, the groove(s) of the upper and the lower mould part is/are formed in such a way that the positioning element protruding from the core is locked in the groove(s). The positioning element locked in the groove cannot escape from the predetermined position, not even when high loads are applied, so the core is arranged within the desired position in the cast workpiece with a high accuracy.

For forming a cavity duplicating the shape of the completed cast workpiece in the casting mould, it is advantageous if sealing surfaces are provided between the upper and the lower mould part, with the contact surface being formed as a portion of the sealing surface of the lower mould part. According to this, the sealing surface of the lower mould part comprises the contact surface that is arranged horizontally particularly during operation, thereby making the positioning of the core in the casting mould considerably easier.

Figure 2A:
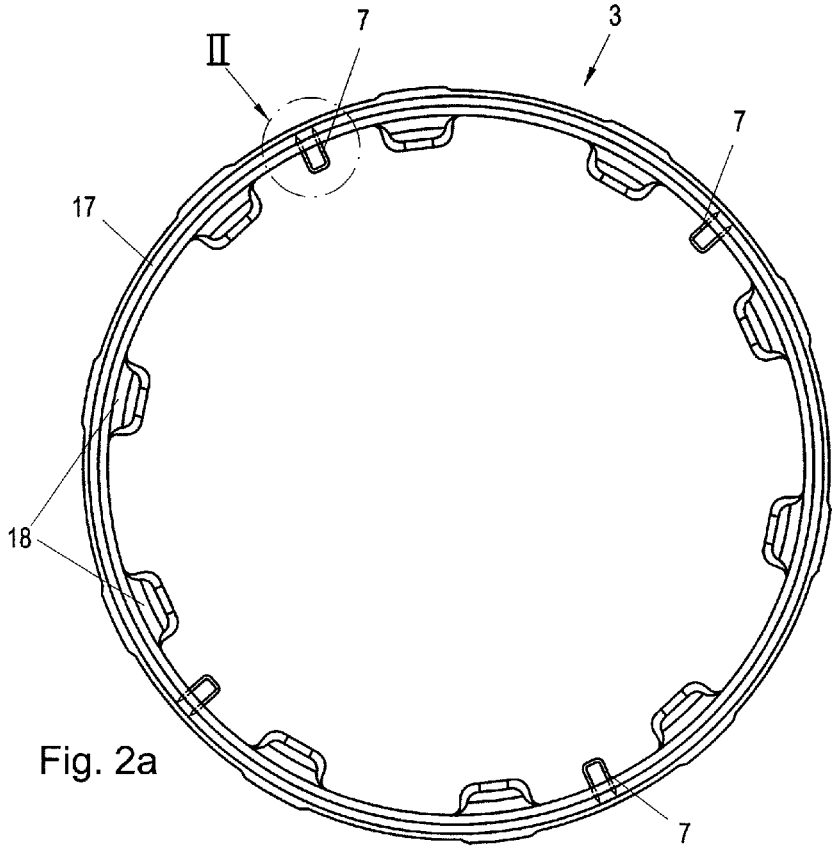
Figure 2B:
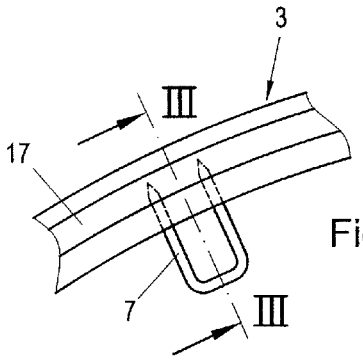
Figure 3:
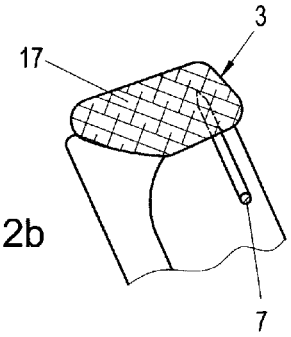

The invention will now be explained by means of exemplary embodiments shown in the figures, however, without being limited to them. In detail, in the drawings:

FIG. 1 shows a cross-section of a section of a casting mould receiving a core surrounded by a light metal;

FIG. 2*a* shows a front view of the core, with bracket-shaped positioning elements being attached to a circumferential rim;

FIG. 2*b* shows the detail highlighted by a circle in FIG. 2*a* in a larger scale;

FIG. 3 shows a sectional view of the core along line C-C in FIG. 2*b;*

Figure 4A:
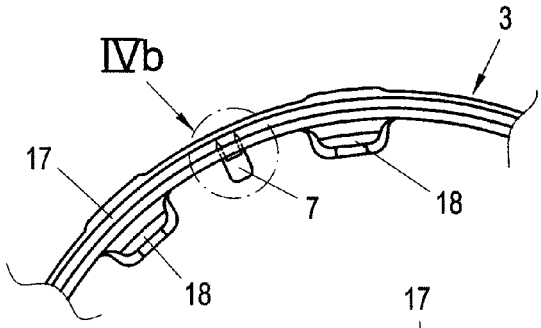
Figure 4B:
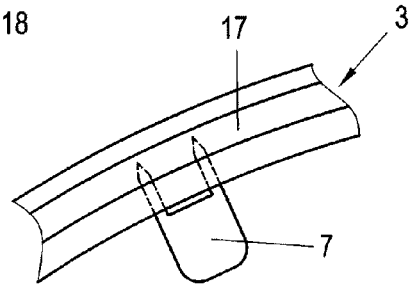
Figure 5A:
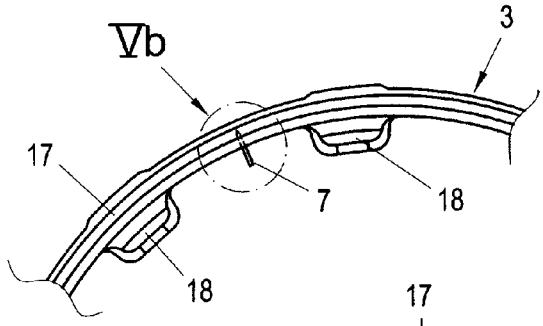
Figure 5B:
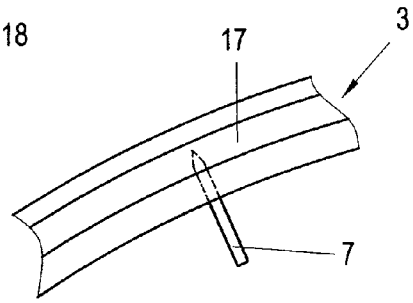

FIG. 4*a* shows a view of a part of the core which is connected to a positioning element having a plate-shaped end region according to another embodiment;

FIG. 4*b* shows the detail highlighted by a circle in FIG. 4*a* in a larger scale;

FIG. 5*a* shows a view of a part of the core which is connected to a pin-shaped positioning element according to another exemplary embodiment; and FIG. 5*b* shows the detail highlighted by a circle in FIG. 5*a* in a larger scale.

FIG. 1 shows a section of a casting mould 1 for producing a cast workpiece 2. In the embodiment shown, a rim or a cast wheel 2' made of a light metal is produced for a motor vehicle. In the casting mould 1, a core 3 is received, having a lower density than a light-metal alloy which is used to surround the core 3 in order to form the cast wheel 2'. The core 3 is pre-formed from a compressed material, for example a porous silicate material, in particular vermiculite; alternatively, the core 3 may consist of metal foam or any other material. By including the core 3, which has a comparably low density, within the cast wheel 2', a reduction in weight can be achieved. As is evident from FIG. 1, the casting mould 1 is formed as a coquille with an upper mould part 4 and a lower mould part 5. In addition, the casting mould 1 comprises, for example, four core sliders 6 adjoining one another in the direction of the circumference. For closing the casting mould 1, the upper mould part 4 is moved towards the lower mould part 5, wherein the lateral core sliders 6 are pushed radially to the inside until they abut against the lower mould part 5. In order to position the core 3 in a predetermined position within the casting mould 1, a positioning element 7, which is connected to the core 3, is provided. The positioning element 7 makes it possible to arrange the core 3 without touching the mould parts 4, 5 when inserting it into the casting mould 1 before surrounding the core 3 by the light-metal alloy. When introducing the light-metal alloy, the core 3 is surrounded by the light-metal alloy from all sides.

In known processes for the production of cast wheels 2', it is common to establish a self-locking connection between the positioning element 7 and the upper mould part 4 for centring the core 3 within the casting mould 1. The core 3 shown, however, has a comparably short extension in the axial direction, so the core 3 does not extend beneath the upper mould part 4. As a consequence, it is not possible to carry out a positioning of the core 3 via a self-locking connection to the upper mould part 4 in this embodiment.

In order to achieve an accurate positioning of the core 3 according to this description in the predetermined position, the positioning element 7 is placed on a contact surface 8 of the lower mould part 5 when positioning the core 3 within the casting mould 1. The core 3 is thus held in the predetermined position without touching the mould parts 4, 5 under the action of the force of gravity. The contact surface 8 is arranged horizontally with respect to an operating position of the casting mould 1. The lower mould part 5 comprises a circular circumferential elevation 9, with the contact surface 8 being a part of its saddle. The elevation 9 has slopes 10, 11 that adjoin the horizontal contact surface 8 radially to the outside and/or radially to the inside. The contact surface 8 and the inner slope 10 of the elevation 9, seen in the radial direction, are formed as portions of sealing surfaces 12 between the correspondingly shaped mould parts 4, 5. The outer slope 11, seen in the radial direction, is concavely bent in accordance with the shape of the completed rim well. Therefore, the slope 11 forms a portion of boundary surfaces 13 enclosing a cavity 14 duplicating the shape of the cast wheel 2'. The contact surface 8 of the lower mould part 5 comprises a groove 16 into which the positioning element 7 is inserted. When closing the casting mould 1, the positioning element 7 is locked between the contact surface 8 of the lower mould part 5 and a contact surface of the upper mould part 4 facing it, in order to secure the core 3 against displacement on all sides.

It can further be seen in FIG. 1 that the end of the positioning element 7 placed on the contact surface 8 protrudes from the completed cast wheel 2'. After surrounding the core 3 by a light metal, the protruding end of the positioning element 7 is cut off. To avoid corrosion, the cast wheel 2' is then lacquered at least in the region of the cut-off end of the positioning element 7; advantageously, a lacquer coating is applied onto the entire cast wheel 2'.

FIGS. 2*a* and 2*b* show an embodiment of the core 3 in which a circular circumferential rim, that is, a ring 17, or annulus, having pockets 18, which extend radially to the inside, is provided. In the embodiment illustrated in FIG. 1, a total of four positioning elements 7 are provided, distributed over the circumference of the ring 17 and fixed to the ring 17 by a friction fit or a force fit. The free end regions of the positioning elements 7 protrude from the ring 17 radially to the inside. Upon inserting the core 3 into the casting mould 1, the end regions of the positioning elements 7 protruding from the core 3 are each placed on a corresponding contact surface 8 of the lower mould part 5. According to FIGS. 2*a* and 2*b*, the positioning element 7 is bent to assume the shape of a bracket, wherein the free ends of the legs of the bracket-shaped positioning element 7 are fixed in the ring of the core 3.

FIGS. 4*a* and 4*b* show an alternative embodiment of the positioning element 7, comprising a plate-shaped end region, which is being placed on the contact surface 8.

In the embodiments shown in FIGS. 5*a* and 5*b*, a pin-shaped positioning element 7 is provided. The positioning element 7 may be fixed within the core 3 in known ways by a form fit and/or a force fit. For a connection by a frictional fit, it is advantageous for the positioning element 7 to have a sharpened end which is driven into the pre-formed core 3.

The invention claimed is:

1. A process for producing a cast wheel, comprising:

inserting a core, which has an annular shape and remains in an area of an outer rim of the cast wheel, but not in an area of a spoke of the cast wheel, into a coquille casting mold having at least a lower coquille mold part and an upper coquille mold part, which are moved relative to one another to close the coquille casting mold;

positioning the core is by at least one positioning element in a predetermined position in the coquille casting mold, wherein an end region of the positioning element is fixed with a force fit or frictional fit in the annular-shaped core;

placing a free end region of the positioning element, which protrudes from the annular-shaped core, on a contact surface of the lower coquille mold part of the coquille casting mold during positioning of the core in the coquille casting mold, so the core is positioned in the predetermined position against the force of gravity.

2. The process according to claim 1, wherein the positioning element is locked between the contact surface of the lower coquille mold part and a corresponding contact surface of the upper coquille mold part when closing the coquille casting mold.

3. The process according to claim 1, wherein a pin-shaped, bracket-shaped or plate-shaped end region of the positioning element protruding from the core is placed on the contact surface of the lower coquille mold part.

4. The process according to claim 1, wherein the free end region of the positioning element protruding from the annular-shaped core substantially radially to an inside is placed on the contact surface of the lower coquille mold part.

5. The process according to claim 4, wherein a plurality of positioning elements, attached to the annular-shaped core spaced apart from each other in the direction of the circumference, are placed on appropriate contact surfaces of the lower coquille mold part.

6. The process according to claim 1, wherein a portion of the positioning element protruding from the completed cast workpiece is removed.

7. The process according to claim 6, wherein the cast workpiece is lacquered or powder-coated, at least in the region of the cut-off end of the positioning element.

8. The process according to claim 1, wherein the contact surface of the lower mold part is arranged substantially horizontally during operation.

9. The process according to claim 1, wherein the core is inserted into the coquille casting mold so that the annular-shaped core remains in an area of a rim well of the cast wheel.

10. The process according to claim 1, wherein the core is inserted into the coquille casting mold so that the annular-shaped core remains in an area of an axially outer portion of a rim well of the cast wheel.

* * * * *